United States Patent [19]

Soum

[11] Patent Number: 4,510,723

[45] Date of Patent: Apr. 16, 1985

[54] PRESTRESSED CABLE ANCHORAGE SYSTEM

[76] Inventor: Rene P. Soum, 33 rue Montcabrier, 31500 Toulouse, France

[21] Appl. No.: 618,327

[22] Filed: Jun. 8, 1984

Related U.S. Application Data

[63] Continuation of Ser. No. 369,792, Apr. 19, 1982, abandoned.

[30] Foreign Application Priority Data

Apr. 24, 1981 [FR] France ..... 81 08616
Mar. 22, 1982 [FR] France ..... 82 05138

[51] Int. Cl.[3] ..... F04C 3/10
[52] U.S. Cl. ..... 52/223 R
[58] Field of Search ..... 52/223 R, 223 C, 226, 52/230

[56] References Cited

U.S. PATENT DOCUMENTS 3,124,385 3/1964 Neptune ..... 52/125.5
3,293,811 12/1966 Rice ..... 52/223 L
3,757,390 9/1973 Edwards ..... 52/223 L
4,053,974 10/1977 Howlett ..... 52/223 R

FOREIGN PATENT DOCUMENTS 88405 4/1960 Denmark .
1609910 1/1970 Fed. Rep. of Germany .... 52/223 R
40747 3/1970 German Democratic Rep... 52/223 L
364606 5/1960 Switzerland ..... 52/223 L
592839 10/1947 United Kingdom ..... 52/230
775744 3/1955 United Kingdom ..... 52/230
846346 8/1960 United Kingdom .

*Primary Examiner*—John E. Murtagh
*Assistant Examiner*—Kathryn L. Ford
*Attorney, Agent, or Firm*—Sandler & Greenblum

[57] ABSTRACT

A prestressed cable anchorage block having at least one orifice bore extending from an anchorage point of the cable to the outlet of the block. The at least one orifice bore has a longitudinally increasing cross section beginning at the point of anchorage until the outlet of the block.

8 Claims, 7 Drawing Figures

PRIOR ART

PRESTRESSED CABLE ANCHORAGE SYSTEM

This application is a continuation of application Ser. No. 369,792 filed Apr. 19, 1982 now abandoned.

BACKGROUND OF THE INVENTION

1. Field of the Invention

The present invention relates to an apparatus for anchoring prestressed cables.

2. Description of Prior Art

FIGS. 4–6 illustrate apparatus for anchoring prestressed cables such as are presently used in construction. The system comprises a block 1 in which are provided, by any known technique, one or more orifices 2 extending through the block, from one end to the other, through which the prestressed cable 4 passes. The prestressed cables, at one of their ends, in front of the anchorage apparatus are provided with or cooperate with an anchorage system including a block and the cable is extended through the orifice of the block. The major disadvantage associated with anchorage apparatus such as shown in FIGS. 4–6 is the bending of cables 4 at the outlet of the block in curvatures having a very low radius when the axis of the cable (or cables) outside of the block (are) is not perfectly aligned with the axis (or axes) of the bore (or bores) and of the portion of the cable situated on the interior of the block. In such apparatus the cable is guided by the orifice bore through which it extends and at the outlet of the orifice the cable follows the direction which is given to it as a function of the forces exerted on the cable and can be out of alignment with respect to the axis of the guided portion. In such a case, at the outlet of the orifice the cable is supported along a single edge and thus over a very small surface area. Since the prestressed cables are under stress a very substantial force is exerted over a very small surface area which results in a very high pressure on the cable which in turn results in very substantial strains which can cause the rupture of the cable. Likewise, because the curvature has a very low radius (a sharp angle) imposed at the outlet of the anchorage apparatus or block, flexional forces in the cable result which may cause its rupture.

So as to avoid the above disadvantages the bores and orifices of known anchorage blocks are inclined, rather than perpendicular with respect to the exterior surface of the block such that the cables are guided directly in the predetermined direction selected as a function of the forces to be exerted. However, this solution has resulted in other problems. In effect, for each orientation of the cable, the block must comprise one (or more) orifices whose axis of inclination is aligned with the anticipated orientation of the cable. This requires the manufacture of a plurality of blocks having a plurality of orifice orientations provided in the blocks.

Furthermore, the manufacture of these blocks is difficult and thus costly, since the drilling of the orifices must be performed at an angle rather than perpendicular with respect to the exterior surface of commercially available blocks such as is shown in FIGS. 4, 5, and 6.

Another prior art solution proposed to overcome the problems stated above has been to provide the blocks with inclined exterior surfaces such that the blocks themselves are inclined with respect to the surface of the prestressed element on which the block is mounted but along the axis of the cable.

However, this technique results in a number of disadvantages. First, the positioning of the blocks during storage is very difficult by virtue of the ordering necessary with respect to the angles of inclination. Second, this approach is insufficient where one block is used to anchor more than one cable, each cable having different orientations of cables at the outlet of the block. Finally, where the actual inclination is different from that anticipated, all of the problems mentioned above will result.

SUMMARY OF THE INVENTION

The present invention has as an object to overcome the disadvantages stated above by providing an anchorage system which makes it possible to allow the prestressed cable to assume any desired inclination without risking rupture regardless of the number of cables per block, and without inclination of the block. The present invention thus permits, by using a single model of block, substitution where previously more than one kind of block was used or where a number of blocks, each having differently inclined bores, were used. This furthermore eliminates the necessity for inclining the blocks themselves.

To achieve this, the anchorage apparatus according to the invention has a bore having a generally increasing cross section from the point of anchorage in the block to the surface of the block which assures the support and guidance of the cable. The surface of the orifice can thus provide the cable with a regular and gradual curvature as it bends from the axis of the cable in the orifice to the axis of the cable extending away from the outlet of the block.

BRIEF DESCRIPTION OF THE DRAWINGS

Other advantages and characteristics of the invention will become clear from the description which follows with reference to one embodiment of the invention given by way of non-limiting example in the annexed drawings in which.

DESCRIPTION OF PREFERRED EMBODIMENTS

The invention relates to a particular type of guidance apparatus for prestressed cables and the like in anchorage systems.

Figure 1:
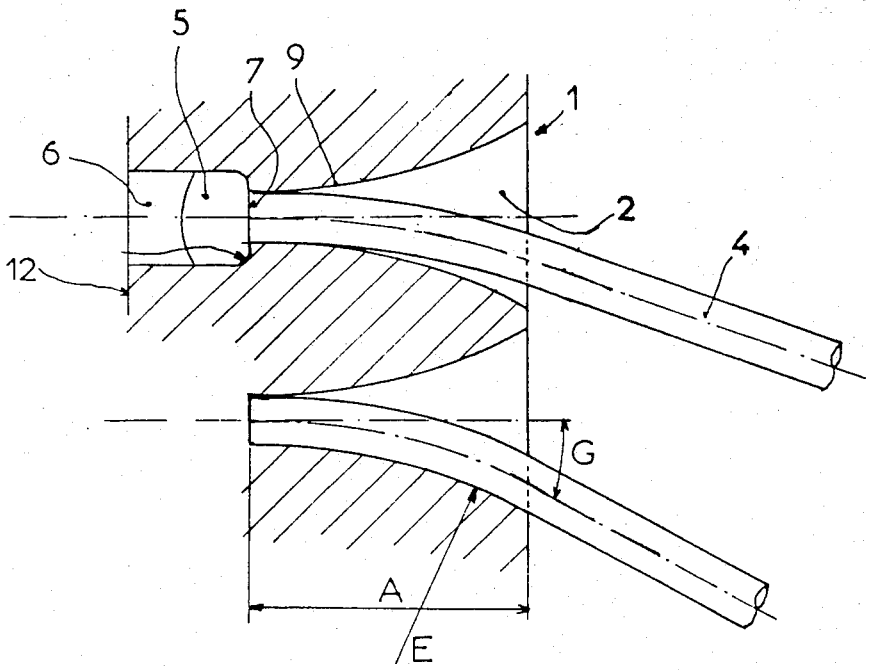
FIG. 1 is a cross sectional view of an anchorage block according to the invention.
Figure 2:
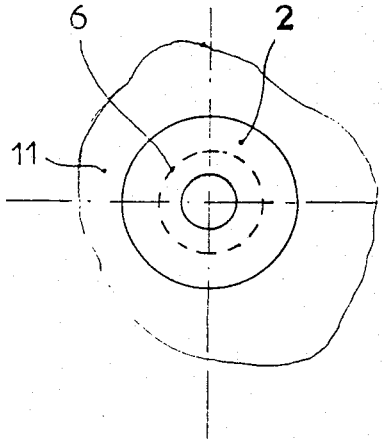
FIGS. 2 and 3 are views of orifices of anchorage blocks according to other embodiments of the invention.
Figure 3:
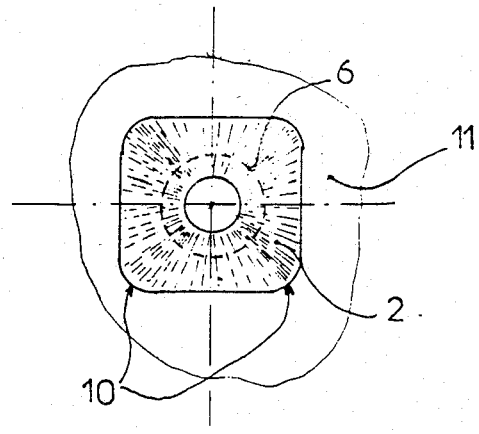
Figure 4:
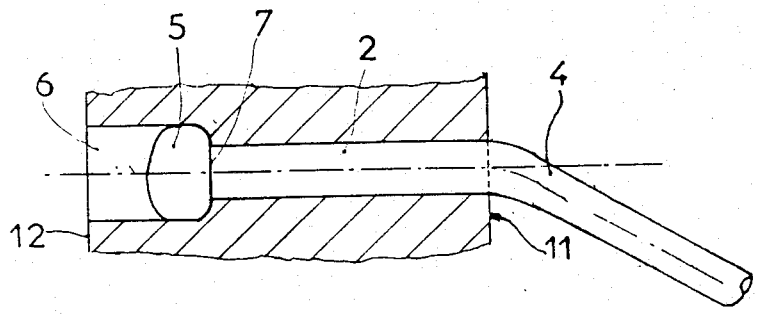
Fig 4 PRIOR ART
FIGS. 4, 5, and 6 are cross sectional views of bores in prior art blocks.
Figure 5:
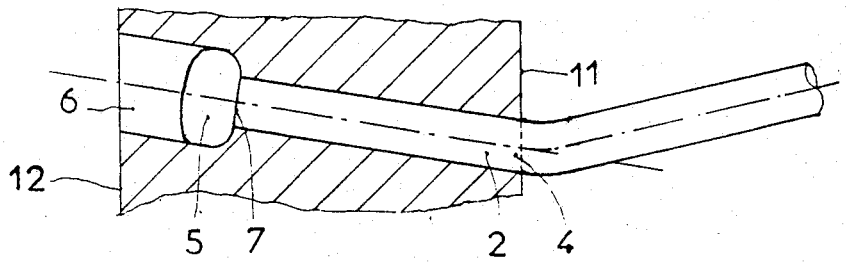
Fig 5 PRIOR ART
Figure 6:
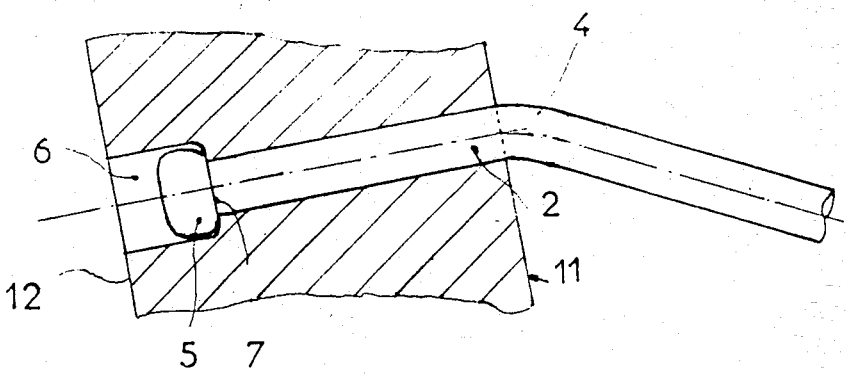
Figure 7:
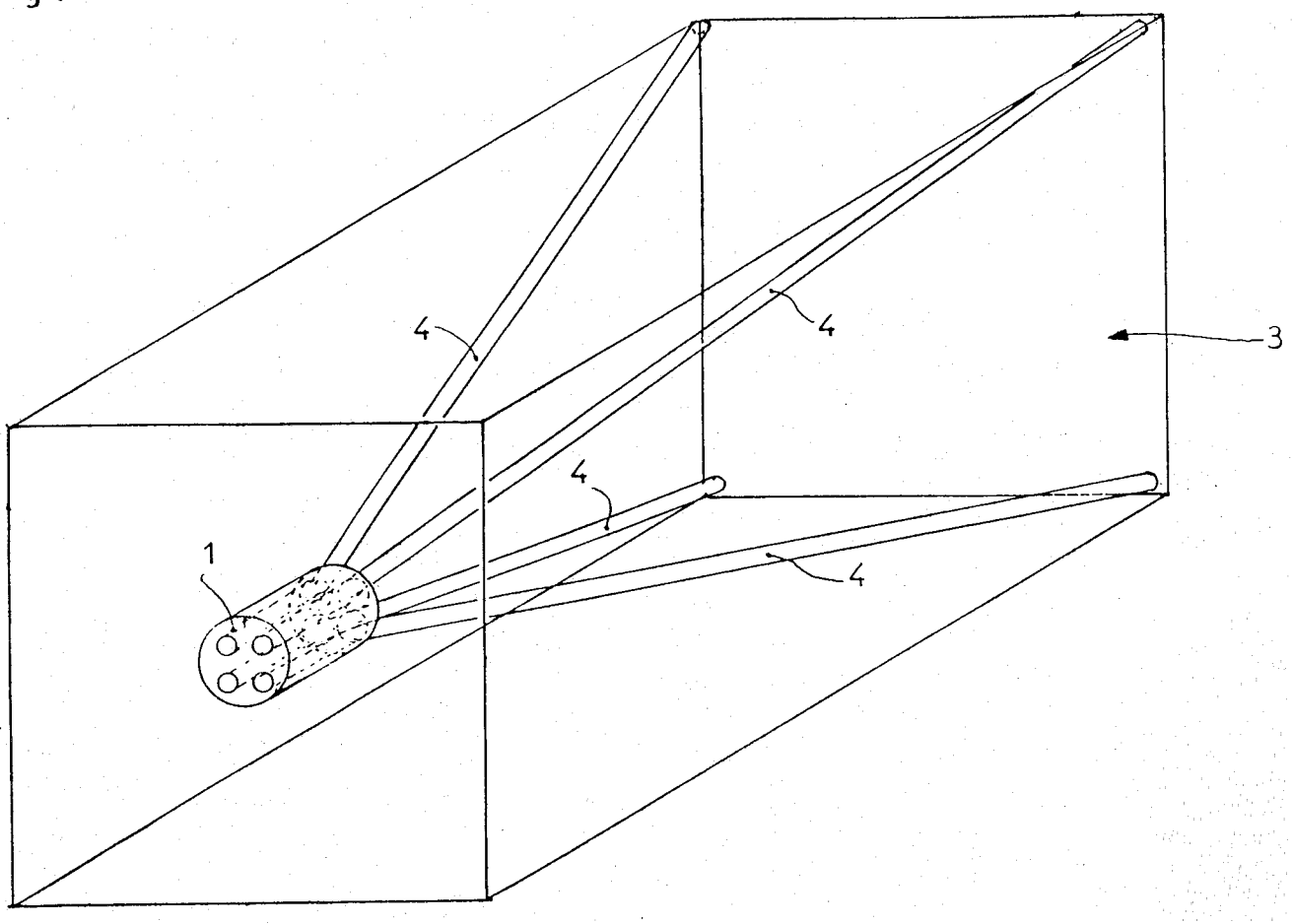
FIG. 7 is a detailed perspective view of the application of the invention according to FIG. 1 using a plurality of guys secured in a single block.

FIGS. 1, 2, and 3 illustrate anchorage blocks 1 used to anchor prestressed cables according to the invention. The anchorage blocks according to the invention comprise a block in which one or more transverse orifice bores 2 are provided allowing for the passage of the cable therethrough. As shown in FIG. 7, construction elements formed in prestressed concrete 3 comprise metallic prestressed elements 4 or cables.

The prestressed cables 4 are stretched by means of a tensioning apparatus (not shown) placed at the two ends of the cables. Anchorage by a bulb or knob 5 in a socket 6 is shown in FIGS. 1–3 wherein possible anchorage systems are illustrated although other systems, such as for example conical blockage systems can also be utilized. The apparatus for tensioning and the elements which constitute this apparatus are not shown because they do not form a part of the invention.

FIG. 7 illustrates prestressed cables 4 in a hypothetical mounting situation. It will be noted that the cables 4, starting at an anchorage position, can be oriented along diverging axes of varying inclinations. The anchorage block according to the invention shown in FIGS. 1, 2 and 3, is characterized in that the bore of orifice 2 has an increasing cross section beginning at anchorage point 7 until the front surface of the block so as to allow for variations in the orientation of the axis of the cable depending upon the selected orientation and in that the orifice bore has a regular curvature.

According to the invention, the prestressed cable extending through the anchorage block has a regular curvature between anchorage point 7 and the outlet of the orifice and the cable can have a large radius depending upon its orientation. Geometrically, the frustoconical bore illustrated is formed in this case by a linear generatrix having a regular curvature. The cable does not rest as in known blocks along a single point, but rests instead along a frustoconical surface formed by a curved linear generatrix. This results in a distribution of the stresses and more extended, smoother, less sharp curves which in turn result in a smaller risk of rupture. Such that the prestressed cable has a regular curvature between the point of anchorage and its axis at the outlet of the anchorage, generatrix 9 of the prestressed cable orifice bore according to one embodiment of the invention preferably is in the form of an arc of a circle. The distance "A" and the radius "E" of the generatrix define the maximum allowable deflection shown by the angle G.

According to the different embodiments shown, the prestressed cable 4 can assume various orientations (FIG. 7) without risking rupture as a result of sudden bends or angles as it leaves the orifice.

According to the embodiment shown in FIG. 3, the cross section of the prestressed cable orifice bore can have the form of a polygon in horizontal, rather than circular, cross section whose angles 10 are rounded so as to provide a greater guide surface to the cable and thus a better distribution of forces.

The prestressed cable orifice axis is generally perpendicular and not inclined with respect to the front surface 11 and rear surface 12 of the block whatever the orientation of the cable with respect to the outlet of the block. Thus, the orifice of the invention is inclined differently from conventional anchorage blocks having orifices whose axes are not positioned along the axis of the cables as they are oriented.

It is thus seen that the invention makes it possible to give to prestressed cables in the anchorage block a regular curvature making it possible to obtain different orientations of the cable at the outlet of the block without it being necessary to incline the block along the axis of the cables and also allowing for different and multiple inclinations of one or more cables in a single block, within one or more orifices without the necessity of one or more inclined orifices.

Although the invention has been described with respect to particular means, materials and embodiments it is to be understood that the invention is not limited to the particulars disclosed but extends to all equivalents falling within the scope of the claims.

What is claimed is:

1. An anchorage block and a prestressed cable, said block comprising at least one orifice bore extending from an anchoring point at which said cable is anchored to said block to an outlet of the block through which said cable extends when it is attached to said block, said orifice bore having a generally increasing cross section beginning at said point and extending to the outlet of the block for supporting the prestressed cable, said orifice bore being curved and having a generatrix in the form of the arc of a circle.

2. The anchorage block as defined according to claim 1 wherein said orifice bore is curved in the direction of the longitudinal axis of the bore.

3. The anchorage block as defined according to claim 1 wherein the generatrix of said at least one orifice bore is a regular curve.

4. The anchorage block according to claim 1 wherein the horizontal cross section of said at least one orifice bore is in the form of a polygon.

5. The anchorage block as defined by claim 4 wherein said polygon has rounded corners.

6. The anchorage block as defined by claim 1 wherein the horizontal cross section of said at least one orifice bore is in the form of a circle.

7. The anchorage block as defined by claim 1 wherein said at least one orifice bore is frustoconical and is formed by a curved line generatrix.

8. An anchorage block and a prestressed cable, said block comprising at least one orifice bore extending from an anchoring point at which said cable is anchored to said block to an outlet of the block through which said cable extends when it is attached to said block, said point comprising means for limiting movement of said cable, both in a substantially horizontal direction and in a substantially vertical direction, said orifice bore having a generally increasing cross-section beginning at said point and extending to the outlet of the block for supporting the prestressed cable, said orifice bore being curved and having a generatrix in the form of an arc of a circle.

* * * * *